US005758947A

United States Patent [19]

Glatt

[11] Patent Number: 5,758,947

[45] Date of Patent: Jun. 2, 1998

[54] ILLUMINATED SAFETY HELMET WITH LAYER FOR ELECTRICALLY CONNECTING LIGHT EMITTING DIODES

[76] Inventor: Terry L. Glatt, 117 Lake Emerald Dr. #103, Oakland Park, Fla. 33309

[21] Appl. No.: 325,108

[22] Filed: Oct. 17, 1994

Related U.S. Application Data

[63] Continuation-in-part of Ser. No. 31,294, Mar. 12, 1993, Pat. No. 5,357,409.

[51] Int. Cl.[6] ..... F21L 15/14

[52] U.S. Cl. ..... 362/105; 362/106

[58] Field of Search ..... 362/105, 103, 362/106, 800

[56] References Cited

U.S. PATENT DOCUMENTS

| | | | |
|---|---|---|---|
| 4,480,293 | 10/1984 | Wells | 362/103 |
| 4,559,586 | 12/1985 | Slarve | 362/106 |
| 4,570,206 | 2/1986 | Deutsch | 362/106 |
| 4,709,307 | 11/1987 | Branom | 362/103 |
| 5,319,531 | 6/1994 | Kutnyak | 362/800 |
| 5,357,409 | 10/1994 | Glatt | 362/800 |
| 5,416,675 | 5/1995 | DeBeaux | 362/800 |
| 5,426,792 | 6/1995 | Murasko | 362/105 |
| 5,479,325 | 12/1995 | Chien | 362/105 |

*Primary Examiner*—Y. My Quach
*Attorney, Agent, or Firm*—Foley & Lardner

[57] ABSTRACT

An illuminated safety helmet including a protective core and a first layer disposed on the protective core. The first layer is a substrate or an impact resistant shell. A plurality of light emitting diodes and traces for electrically connecting the light emitting diodes are disposed on the substrate or impact resistant shell. As such, when the substrate or impact resistant shell is disposed on the core, the light emitting diodes are automatically disposed around the protective core. The illuminated safety helmet also includes control circuitry for illuminating the light emitting diodes and a power source for powering the control circuitry and the light emitting diodes.

21 Claims, 5 Drawing Sheets

ILLUMINATED SAFETY HELMET WITH LAYER FOR ELECTRICALLY CONNECTING LIGHT EMITTING DIODES

CROSS-REFERENCE TO RELATED APPLICATION

This application is a continuation-in-part of U.S. patent application Ser. No. 08/031,294, filed on Mar. 12, 1993, now U.S. Pat. No. 5,357,409, issued Oct. 18, 1994.

FIELD OF THE INVENTION

The present invention relates to safety devices for recreational and occupational activities and, more particularly, to illuminated safety helmet having a layer for mounting light emitting diodes.

BACKGROUND OF THE INVENTION

My copending application identified above describes an illuminated safety helmet having a plurality of light emitting diodes ("LEDs") disposed around a protective core. The LEDs are mounted in holes extending partially or completely through the protective core. Current is supplied to the LEDs by wires individually connected to the contact or lead of each LED. In the context of mass production, the manufacturing steps required to mount LEDs in holes in the protective core and to connect individual wires to the contact of each LED are time consuming and, consequently, relatively expensive. Furthermore, these manufacturing steps are difficult to automate.

Accordingly, it is an object of the invention to provide an illuminated safety helmet that is relatively simple and inexpensive to manufacture, especially in mass production.

Another object of the invention is to provide an illuminated safety helmet that can be reliably manufactured by an automated process.

A further object of the invention is to provide a reliable and durable illuminated safety helmet.

A still further object of the invention is to provide an illuminated safety helmet that allows flexibility in the location of the components including, for example, the LEDs, control circuitry, and power source.

Additional objects and advantages of the invention will be set forth in part in the description which follows, and in part will be obvious from the description, or may be learned by practice of the invention. The objects and advantages of the invention will be realized and attained by means of the instrumentalities and combinations particularly pointed out in the appended claims.

SUMMARY OF THE INVENTION

To achieve the objects and in accordance with the purpose of the invention, as embodied and broadly described herein, the illuminated safety helmet of the invention includes a protective core. A first layer is disposed on the protective core. The first layer may be a substrate or an impact resistant shell. The first layer has a plurality of LEDs and traces for electrically connecting the LEDs disposed thereon. As such, when the first layer is disposed on the core, the LEDs are automatically disposed around the protective core. Control circuitry for illuminating the LEDs and a power source for powering the control circuitry and the LEDs also are provided.

In the preferred embodiments of the invention, the first layer is a substrate having a central portion and a plurality of extensions or finger portions extending from the central portion. Preferably, the LEDs are disposed on the finger portions of the substrate. An outer layer is disposed on the substrate. The outer layer may be an impact resistant shell or a thin skin of stretchable material.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DESCRIPTION OF THE PREFERRED EMBODIMENT

Reference will now be made in detail to the present preferred embodiments of the invention, examples of which are illustrated in the accompanying drawings.

Figure 1:
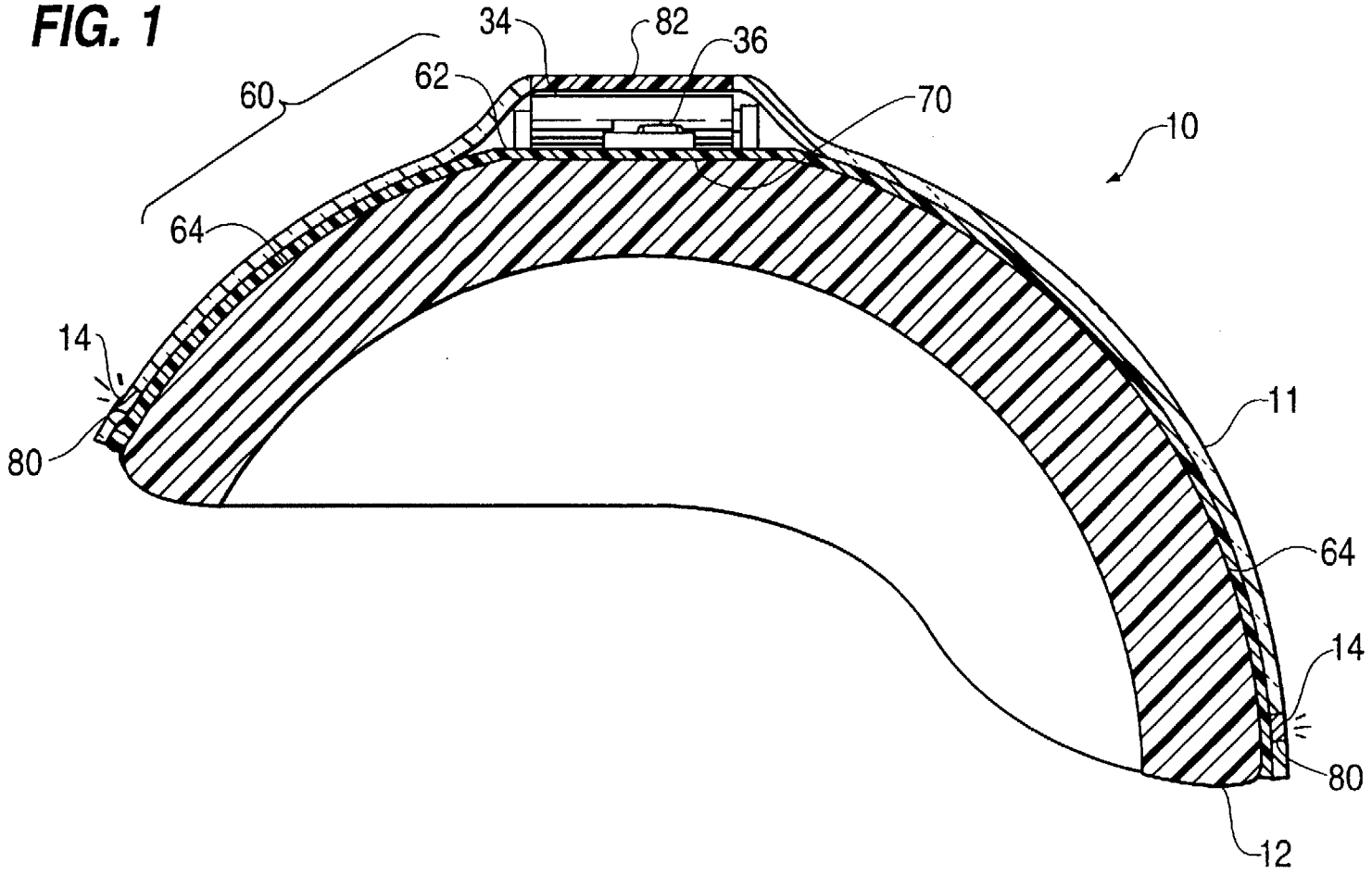
FIG. 1 is a cross-sectional view of a first preferred embodiment of the illuminated safety helmet of the invention.

A first preferred embodiment of the safety helmet is shown in FIG. 1 and is represented generally by numeral 10. The internal portion of protective core or body 12 is provided with protective foam padding (not shown) found in conventional safety helmets. Protective core 12 provides impact absorption and is made of styrofoam or other suitable material. Those skilled in the art will recognize that most conventional safety helmets designed for recreational and occupational activities are suitable for use in the present invention.

Figure 2:
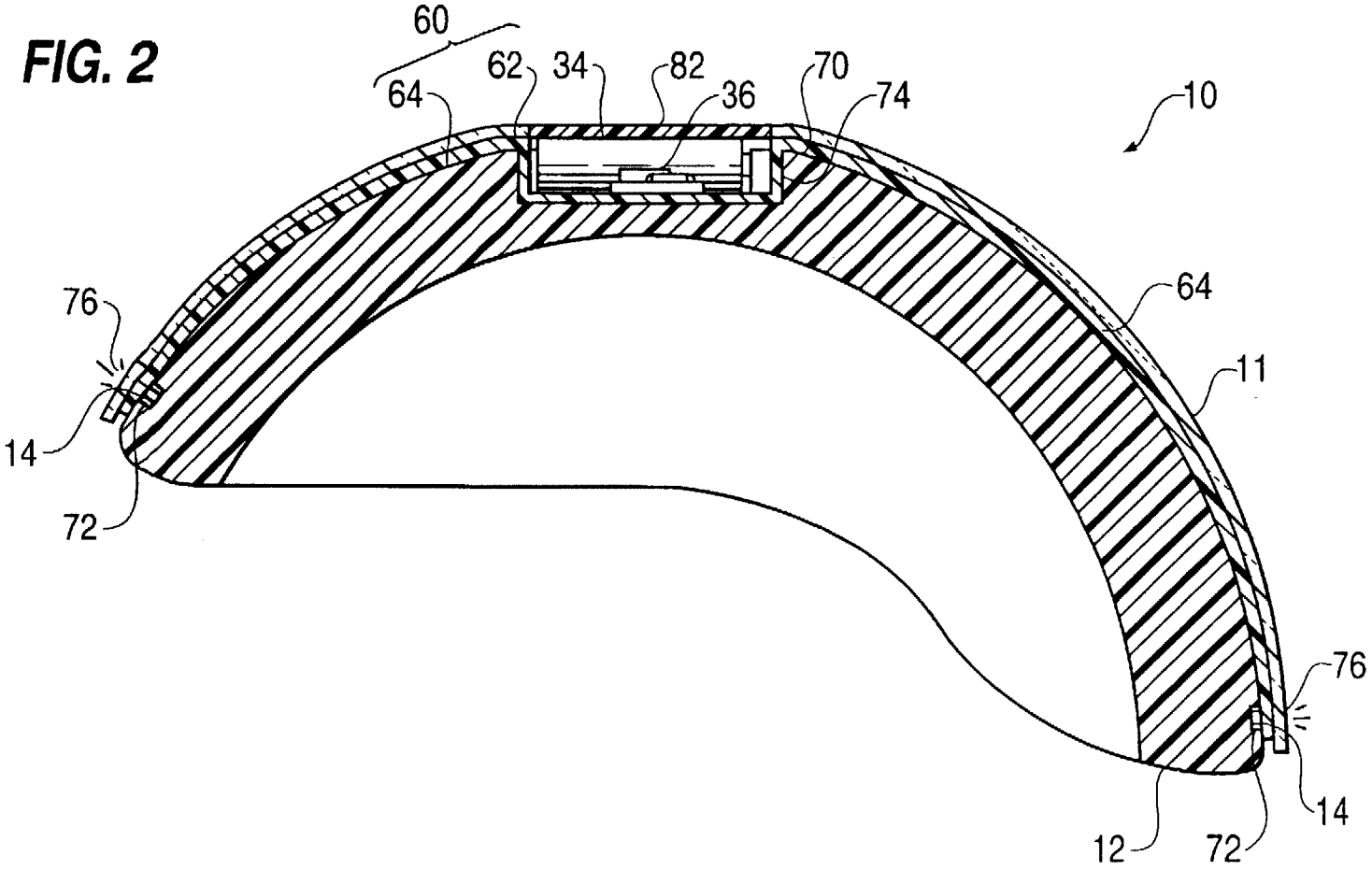
FIG. 2 is a cross-sectional view of a second preferred embodiment of the illuminated safety helmet of the invention.
Figure 4:
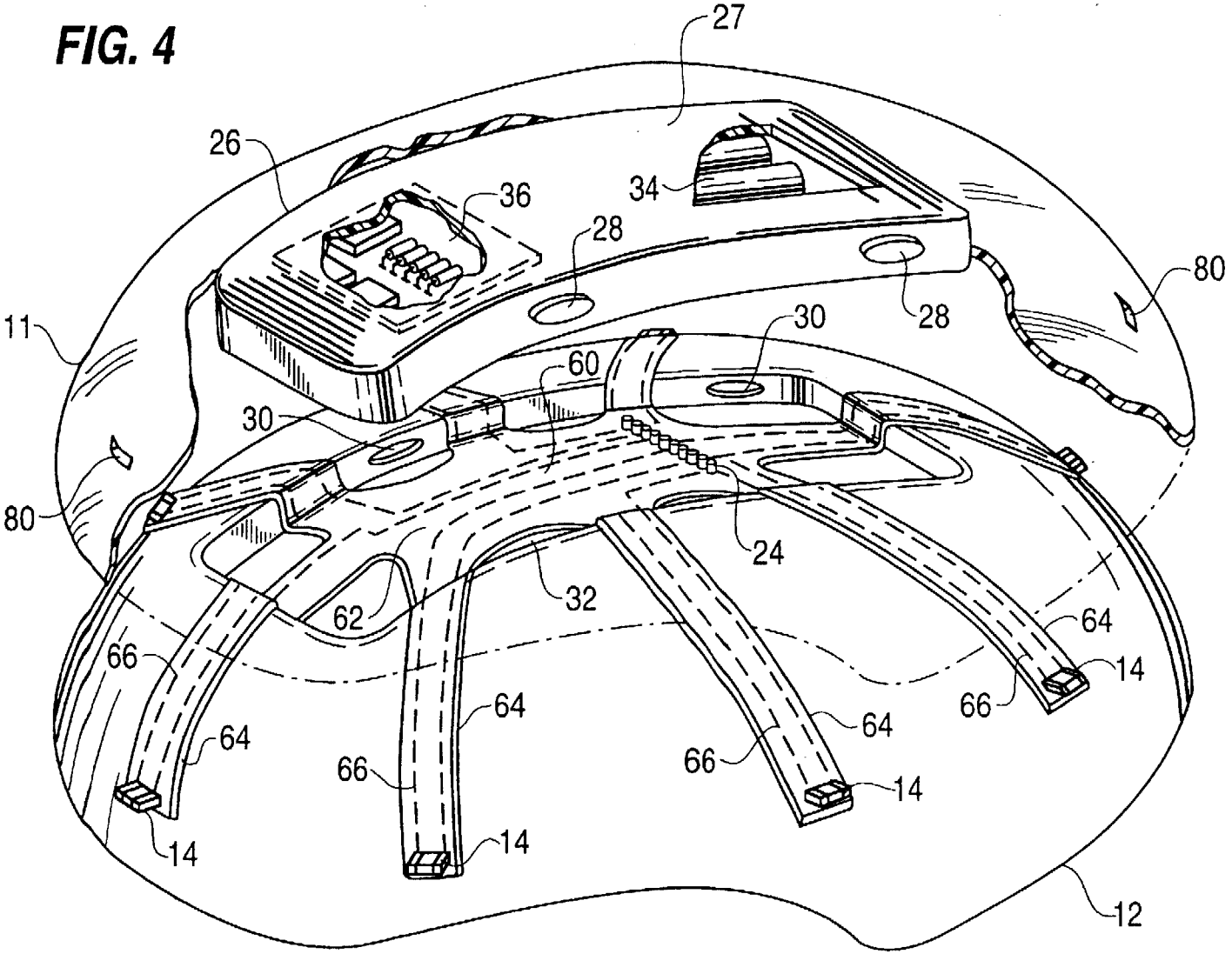
FIG. 4 is a perspective view of a third preferred embodiment of the illuminated safety helmet of the invention which includes a cut-away view of a housing for enclosing control circuitry and a power source.

In the safety helmet of the present invention, a plurality of LEDs are disposed around the protective core of the safety helmet. As shown in FIGS. 1, 2, and 4, LEDs 14 are disposed around the periphery of protective core 12. It is preferred that the LEDs are surface mount technology (SMT) LEDs; however, other commercially available LEDs are suitable for use in the invention. To maximize visibility, super bright or ultra bright LEDs, which approach 2000 mcd, could be used. Laser diodes also can be used in the invention. The beams emitted by the laser diodes would be rendered visible by moisture or dust in the air.

Figure 3:
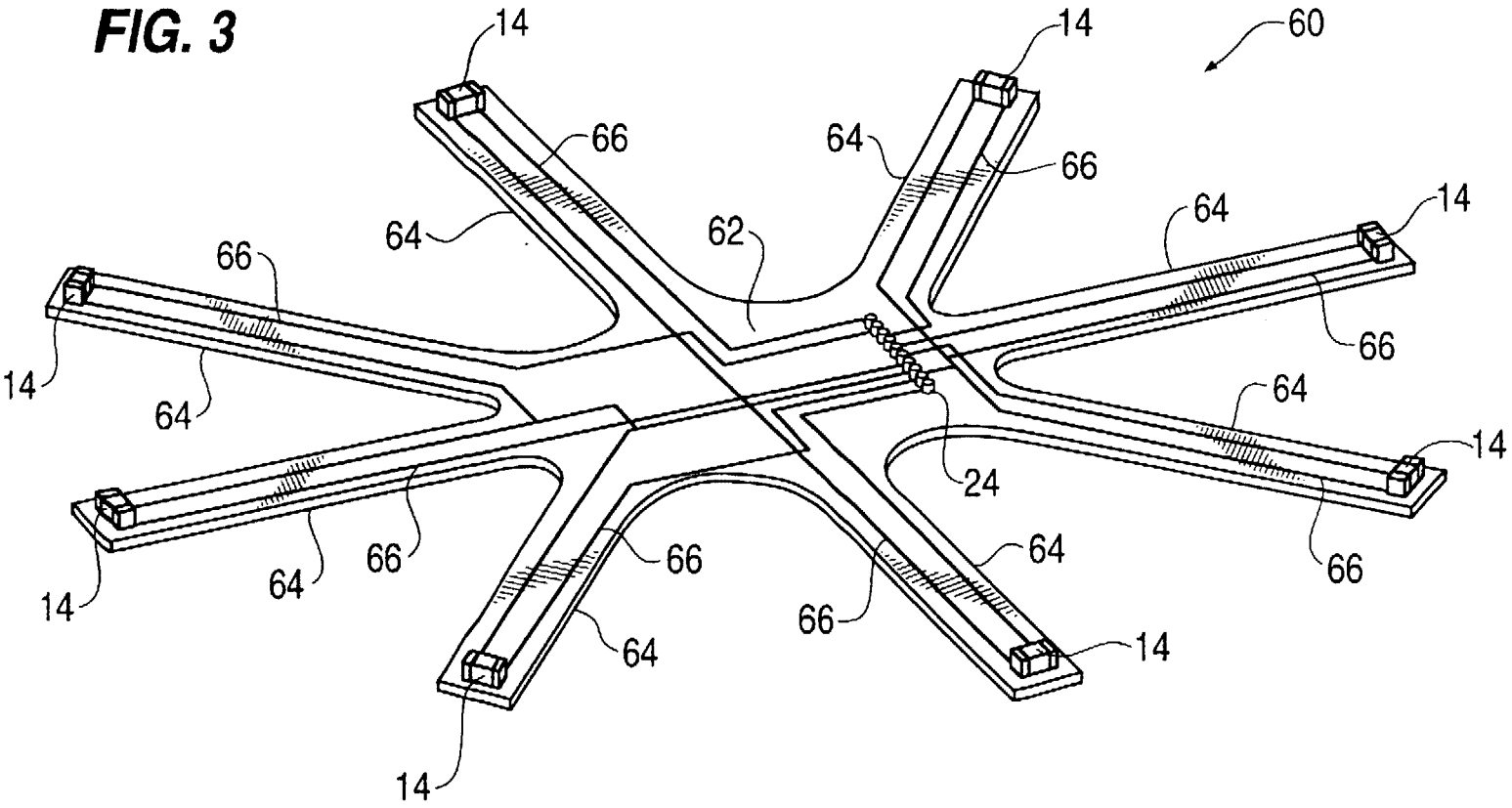
FIG. 3 is a perspective view of a preferred embodiment of a substrate having LEDs and traces for electrically connecting the LEDs and a power source thereon.

In accordance with the invention, a first layer is disposed on the protective core. The first layer has traces for electrically connecting the LEDs disposed thereon. If desired, the first layer also may have traces for electrically connecting a power source and/or control circuitry disposed thereon. In the preferred embodiments shown herein, the first layer is a substrate. Alternatively, the first layer may be an impact resistant shell. Referring to FIG. 1, substrate 60 is disposed on protective core 12. The substrate preferably includes a central portion and a plurality of extensions or finger portions extending from the central portion. As shown in FIG. 3, substrate 60 includes central portion 62 and eight finger portions 64 extending radially outwardly from central portion 62. Substrate 60 may be made of any suitable flexible material. The preferred materials for substrate 60 include Plastic Film, e.g., MYLAR and other flexible polymeric materials.

When the first layer is an impact resistant shell, LEDs may be disposed on or made integral with the shell by affixing the LEDs to the shell with solder or a conductive adhesive. The traces for electrically connecting the LEDs would be printed on the inside surface of the shell.

In the preferred embodiment shown in FIG. 3, eight SMT LEDs 14 are disposed on substrate 60. In particular, LEDs 14 are disposed on the end of each finger portion 64 of substrate 60. LEDs 14 may be disposed on substrate 60 by soldering or conductive-pasting LEDs 14 to pads (not shown) deposited on substrate 60 with traces 66. Suitable SMT LEDs include Panasonic LNIXXX Series, Lumex SSL-LX15 Series, and LiteOn SMD Series. Traces 66 of copper or other suitable conductive material are disposed on substrate 60 to electrically connect LEDs 14 with an appropriate connector such as connector 24. Traces 66 may be disposed on substrate 60 by known deposition techniques such as printing or photo etching.

In the first preferred embodiment shown in FIG. 1, the top of protective core 12 includes flattened portion 70. Substrate 60 is disposed on protective core 12 so that at least a portion of central portion 62 rests on flattened portion 70. The length of each finger portion 64 extending radially outwardly from central portion 62 is selected so that each finger portion 64 terminates at the periphery of protective core 12. As such, when substrate 60 is aligned on protective core 12, LEDs 14 disposed on the ends of finger portions 64 are automatically disposed around the periphery of protective core 12.

It is preferred that at least four LEDs are disposed around the protective core. The preferred embodiment of substrate 60 shown in FIG. 3 includes eight LEDs 14, only two of which can be seen in FIG. 1, disposed on eight finger portions 64. The spacing between finger portions 64 is such that when substrate 60 is aligned on protective core 12 LEDs 14 are substantially equally spaced around the periphery of protective core 12 in a generally circular pattern. It will be apparent to those skilled in the art that the configuration of the substrate can be modified to accommodate either more or less than eight LEDs as well as to vary the positioning of the LEDs to form, for example, a pattern. It also will be apparent that more than one LED may be disposed on each finger portion and that the LEDs may be disposed anywhere on the finger portions.

In accordance with the invention, the LEDs are illuminated by control circuitry. To maximize the protection afforded by the safety helmet of the present invention, it is preferred that the LEDs are sequentially illuminated by control circuitry. As used herein, the phrase "sequential illumination" means that one or more LEDs are alternately illuminated. In the preferred embodiments shown herein, one of LEDs 14 is illuminated at a time in positional sequence around protective core 12 by the control circuitry shown in FIG. 5 and described in detail below. LEDs 14 are preferably illuminated in positional sequence at a rate at which they appear to be in motion. Such sequential illumination triggers a viewer's temporal response system, which is more sensitive in the periphery of the field of view, and results in earlier detection of a person wearing the safety helmet of the present invention.

Those skilled in the art are familiar with the frequencies required to sequentially illuminate LEDs so that they appear to be in motion. In general, the human eye will perceive that a light source is continuously illuminated at frequencies exceeding approximately 30 Hz.

Figure 5:
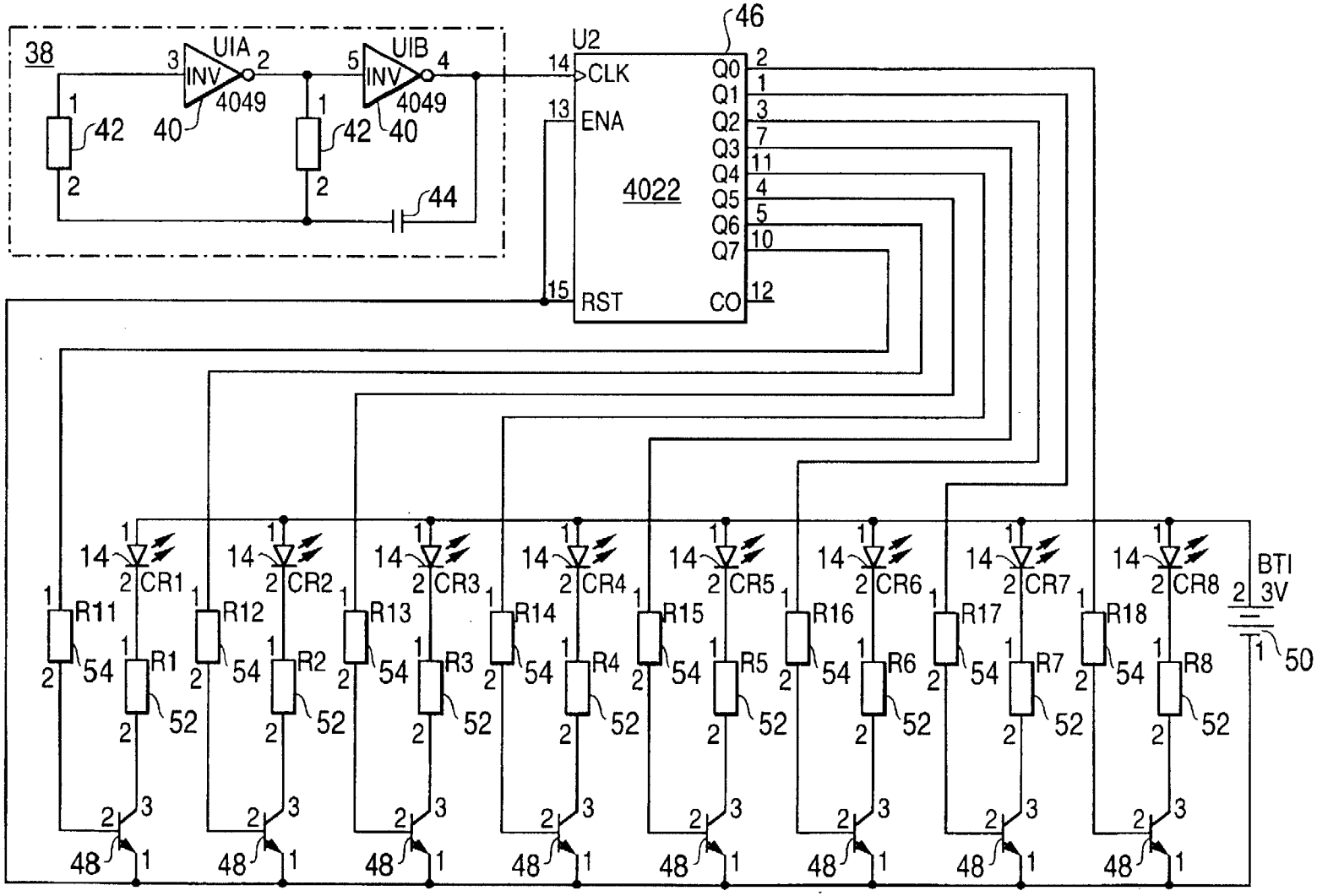
FIG. 5 is a schematic diagram of the preferred control circuitry for sequentially illuminating eight LEDs.

FIG. 5 is a schematic diagram of the preferred control circuitry for sequentially illuminating eight LEDs. Referring to FIG. 5, oscillator 38 is comprised of inverters 40 from a 4069 inverter package, resistors 42, and capacitor 44. Oscillator 38 sends a clock signal to ring counter 46. The frequency of ring counter 46 can be varied by adjusting resistors 42 and capacitor 44. The outputs of ring counter 46 each drive a transistor 48 configured as a common-emitter switch. LEDs 14 are connected in series with power source 50, current limiting resistor 52, and the collector for each transistor 48. When the base of one of the transistors 48 is driven high, i.e., to logic 1, through one of 3.8K ohm resistors 54, the corresponding LED 14 is illuminated.

It will be apparent to those skilled in the art that the control circuitry can be varied to illuminate more than one LED at a time. For example, two or three LEDs could be illuminated at a time in positional sequence so that the group of LEDs appears to be in motion. In addition, all LEDs could be alternately illuminated so that the safety helmet flashes on and off. It also will be apparent that LEDs 14 can be disposed on protective core 12 in a different order than they are electrically connected to ring counter 46 to produce a different illumination pattern. For example, diametrically opposed LEDs could be sequentially illuminated in pairs to effect a "star" pattern around the helmet.

A power source is provided to power the control circuitry and the LEDs. In the preferred embodiments shown herein, power is provided by battery or batteries 34 as shown in FIGS. 1, 2, and 4. If desired, battery or batteries 34 may be rechargeable. In addition, the power source may include a solar array.

In the first preferred embodiment shown in FIG. 1, circuit board 36 and battery 34 are mounted above flattened region 70 of protective core 12. In particular, circuit board 36 and battery 34 are mounted on the portion of central portion 62 which is disposed on flattened portion 70 of protective core 12. It is preferred that circuit board 36 and battery 34 are mounted on a flat surface to facilitate mounting. Circuit board 36 and battery 34 may be affixed to central portion 62 by known methods such as, for example, adhesives or a snap-on arrangement. Circuit board 36, which is electrically connected to battery 34 as shown at 50 in FIG. 5, is electrically connected to traces 66 by an appropriate connector such as connector 24 shown in FIG. 3 in central portion 62 of substrate 60. When the first layer is an impact resistant shell, a suitable means for electrically connecting the traces to the control circuitry and power source is provided. For example, a mating half of a connector may be affixed to the shell and the other mating half of the connector may be affixed to the circuit board.

In accordance with the invention, an outer layer is disposed on the substrate. In the first preferred embodiment shown in FIG. 1, outer layer 11 is an impact resistant shell that conforms to the contour of protective core 12 except for an interruption to accommodate circuit board 36 and battery 34. Outer layer 11 includes a plurality of openings 80 for receiving LEDs 14. Depending on the thickness of outer layer 11 and the size of LEDs 14, LEDs 14 may extend partially or completely through openings 80. Outer layer 11 also includes removable cover 82 for accessing circuit board 36 and battery 34. Cover 82 is removably attached to S outer layer 11 by a snap-in arrangement. Those skilled in the art will recognize that cover 82 also may be removably attached by other equivalent means including, for example, screws, clips, or a hinge mechanism.

A second preferred embodiment of the safety helmet is shown in FIG. 2. In the second preferred embodiment, LEDs 14 and traces 66 (traces 66 cannot be seen in FIG. 2) are disposed on the side of substrate 60 facing protective core 12. As shown in FIG. 2, LEDs 14 are received in recesses 72 in protective core 12. In addition, circuit board 36 and battery 34 are disposed in recess 74 located in flattened portion 70 of protective core 12. Disposing circuit board 36 and battery 34 in recess 74 avoids the need to interrupt the contour of outer layer 11 to accommodate those components as shown in FIG. 1. Access to circuit board 36 and battery 34 is provided by removable cover 82 as described with respect to the first preferred embodiment shown in FIG. 1.

Due to the location of LEDs 14 in the second preferred embodiment, light from LEDs 14 must pass through finger portions 64 of substrate 60 as well as outer layer 11 to make the wearer of helmet 10 visible to others. Thus, in the second preferred embodiment, substrate 60 must be made of a material capable of transmitting light such as, for example, transparent Mylar. Alternatively, only the areas of finger portions 64 proximate to LEDs 14 may be made of a material capable of transmitting light. As shown in FIG. 2, outer layer 11 includes lenses 76 for transmitting light through layer 11. Lenses 76 may be made by, for example, using a transparent shell and leaving portions of the shell unfinished at the locations of the LEDs. Alternatively, lenses 76 may be omitted in favor of openings 80 described in connection with the first preferred embodiment and shown in FIG. 1.

Those skilled in the art will recognize that the location of the circuit board and the battery shown in FIGS. 1 and 2 can be varied. For example, the circuit board and the battery may be disposed in a recess in the rear portion of the protective core. If necessary, the rear portion of the core may be exaggerated to provide the wearer with protection from the battery. In the event that the location of the circuit board and the battery is changed, it would be apparent to those skilled in the art to modify the configuration of the substrate to accommodate the changed location of the circuit board and the battery. It also would be apparent to those skilled in the art that either or both of the circuit board and the battery could be mounted off the substrate. In this event, either the circuit board or the battery would be connected to the substrate by wires.

A third preferred embodiment of the safety helmet is shown in FIG. 4. In the third preferred embodiment, a housing for enclosing the control circuitry and the power source is provided. Referring to FIG. 4, housing 26 encloses circuit board 36 and batteries 34. Housing 26 is preferably made of molded plastic but also can be made from other lightweight, weatherproof materials capable of protecting the control circuitry and the power source from rain, snow, and the like. The interior of the housing is preferably molded to securely accommodate circuit board 36 and batteries 34. As can be appreciated from FIG. 4, housing 26 is disposed in recessed portion 32 of protective core 12 so that top surface 27 of housing 26 is flush with protective core 12. The depth of recessed portion 32 should be selected to avoid jeopardizing the impact protection provided by helmet 10. Alternatively, housing 26 may be configured so that top surface 27 is either above or below the external surface of protective core 12.

Housing 26 is electrically connected to LEDs 14 by connector 24. As shown in FIG. 4, the female half of connector 24 is disposed in recessed portion 32 of protective shell 12. The posts of the female half of connector 24 extend through holes in substrate 60 so that they are electrically connected to LEDs 14 by way of traces 66. The male half of connector 24 (not shown) is disposed on housing 26 and, as can be appreciated in FIGS. 4 and 5, is electrically connected to circuit board 36 and batteries 34. Housing 26 is electrically connected to LEDs 14 by plugging the male half of connector 24 (not shown) into the female half of connector 24. It will be apparent to those skilled in the art that the male and female halves of connector 24 could be reversed so that the male half is disposed in recessed portion 32 and the female half is disposed on housing 26 provided that the contacts of the male half of the connector are in contact with traces 66 on substrate 60.

As shown in FIG. 4, housing 26 is removably attached to protective core 12 by disposing it in recessed portion 32 so that snaps 28 on the sides of housing 26 fit into depressions 30 in the walls of recessed portion 32. Those skilled in the art will recognize that, if desired, the housing can be attached to a protective core that does not have a recessed portion. Those skilled in the art also will recognize that other equivalent structures for removably attaching the housing to the protective core including, but not limited to, screws, clips, magnets, or strips of synthetic materials which adhere when pressed together, e.g., VELCRO may be used in the invention.

It will be apparent to those skilled in the art that various modifications and variations can be made in the illuminated safety helmet of the invention without departing from the scope of the invention as defined in the following claims.

What is claimed is:

1. An illuminated safety helmet, comprising:

a protective core;

a first layer disposed on said core, said first layer having a plurality of light emitting diodes and electrical conductive pathways for electrically connecting said light emitting diodes disposed thereon;

control circuitry for controlling illuminations of said light emitting diodes; and a power source for powering said control circuitry and said light emitting diodes, wherein said first layer has a central portion and a plurality of finger portions extending from said central portion.

2. The helmet of claim 1, wherein said first layer is a substrate.

3. The helmet of claim 2, further comprising a second layer disposed on said substrate.

4. The helmet of claim 3, wherein said second layer is an impact resistant shell.

5. The helmet of claim 3, wherein said second layer is a thin skin of stretchable material.

6. The helmet of claim 1, wherein a light emitting diode is disposed on each of said finger portions.

7. The helmet of claim 6, wherein at least four light emitting diodes are disposed on said first layer.

8. The helmet of claim 5, wherein eight light emitting diodes are disposed on said first layer so that said light emitting diodes are substantially equally spaced around the periphery of said core in a generally circular pattern.

9. The helmet of claim 1, wherein said first layer is an impact resistant shell.

10. An illuminated safety helmet, comprising:

a protective core;

a substrate disposed on said core, said substrate having a plurality of light emitting diodes and electrical conductive pathways for electrically connecting said light emitting diodes disposed thereon;

control circuitry for controlling illuminations of said light emitting diodes;

a power source for powering said control circuitry and said light emitting diodes; and an outer layer disposed on said substrate, wherein said substrate has a central portion and a plurality of finger portions extending from said central portion.

11. The helmet of claim 10, wherein a light emitting diode is disposed on each of said finger portions.

12. The helmet of claim 11, wherein eight light emitting diodes are disposed on said substrate so that said light emitting diodes are substantially equally spaced around the periphery of said core in a generally circular pattern.

13. The helmet of claim 10, wherein said core has a flattened portion.

14. The helmet of claim 13, wherein at least a portion of said central portion of said substrate is disposed on said flattened portion of said core.

15. The helmet of claim 14, wherein said control circuitry and said power source are mounted on the portion of said central portion of said substrate disposed on said flattened portion of said core.

16. The helmet of claim 13, wherein said control circuitry and said power source are disposed in a recess in said flattened portion of said core.

17. The helmet of claim 10, wherein said outer layer is an impact resistant shell.

18. The helmet of claim 10, wherein said outer layer is a thin skin of stretchable material.

19. An illuminated safety helmet, comprising:

a protective core;

a substrate disposed on said core, said substrate having a plurality of light emitting diodes and electrical conductive pathways for electrically connecting said light emitting diodes disposed thereon, said substrate further having a central portion and a plurality of finger portions extending from said central portion, said light emitting diodes being disposed on said finger portions of said substrate;

control circuitry for controlling illuminations of said light emitting diodes;

a power source for powering said control circuitry and said light emitting diodes; and an outer layer disposed on said substrate.

20. The safety helmet of claim 19, wherein said outer layer is an impact resistant shell.

21. The safety helmet of claim 19, wherein said outer layer is a thin skin of stretchable material.

* * * * *